US010906162B2

(12) United States Patent
Chang et al.

(10) Patent No.: US 10,906,162 B2
(45) Date of Patent: Feb. 2, 2021

(54) SCREW CLAMPING DEVICE

(71) Applicant: NATIONAL CHUNG SHAN INSTITUTE OF SCIENCE AND TECHNOLOGY, Taoyuan (TW)

(72) Inventors: Han-Hsiang Chang, Taoyuan (TW); Kui-Chin Liu, Taoyuan (TW); Yung-Lin Lin, Taoyuan (TW)

(73) Assignee: NATIONAL CHUNG SHAN INSTITUTE OF SCIENCE AND TECHNOLOGY, Taoyuan (TW)

( * ) Notice: Subject to any disclaimer, the term of this patent is extended or adjusted under 35 U.S.C. 154(b) by 470 days.

(21) Appl. No.: 15/874,073

(22) Filed: Jan. 18, 2018

(65) Prior Publication Data

US 2019/0105763 A1 Apr. 11, 2019

(30) Foreign Application Priority Data

Oct. 6, 2017 (TW) ..... 106134568 A

(51) Int. Cl.
*B25B 23/10* (2006.01)
*B25B 15/02* (2006.01)

(52) U.S. Cl.
CPC ..... *B25B 23/101* (2013.01); *B25B 15/02* (2013.01); *B25B 23/10* (2013.01)

(58) Field of Classification Search
CPC ..... B25B 23/101; B25B 15/02; B25B 23/10; B25B 23/108; B25B 15/005; B25B 23/005; B25B 23/02; B25B 23/08; B25B 23/105
USPC ..... 81/451, 452, 453, 454, 455, 456, 457, 81/458
See application file for complete search history.

(56) References Cited

U.S. PATENT DOCUMENTS 1,424,703 A * 8/1922 Work ..... B25B 23/101 81/455
1,575,149 A * 3/1926 Craig ..... B25B 23/101 81/455
1,779,339 A * 10/1930 Sokoloff ..... B25B 23/10 81/452

(Continued)

FOREIGN PATENT DOCUMENTS

KR 1020160100481 * 8/2016 ..... B25B 15/02

OTHER PUBLICATIONS

Robert L Norton, Design Of Machinery, 2012, McGraw-Hill, 5th edition, p. 401, section 8.0 (Year: 2012).*

*Primary Examiner* — David B. Thomas
*Assistant Examiner* — Robert F Neibaur
(74) *Attorney, Agent, or Firm* — Schmeiser, Olsen & Watts, LLP

(57) ABSTRACT

A screw clamping device includes a body, a pressing unit, a resilient unit, a clamping unit and a connecting unit. The body is a hollow-core cylinder, is subject to axial penetration of a screwdriver, and is movable axially in synchrony with rotation of the screwdriver. The pressing unit is disposed on the body and adapted to press against a surface of a working object. The resilient unit is disposed between the body and the pressing unit. The clamping unit is rotatably connected to the body. The connecting unit has one end connected to the pressing unit and the other end connected to the clamping unit. While the body is moving axially, the connecting unit drives the clamping unit to rotate and thereby clamp or loosen screws.

8 Claims, 6 Drawing Sheets

(56) References Cited

U.S. PATENT DOCUMENTS

| | | | | | |
|---|---|---|---|---|---|
| 2,576,742 | A * | 11/1951 | Wolny | B25B 23/101 | 81/453 |
| 3,949,795 | A * | 4/1976 | Hull | B25B 23/10 | 81/454 |
| 3,965,950 | A * | 6/1976 | MacDonald | B25B 23/10 | 81/455 |
| 6,244,141 | B1 * | 6/2001 | Han | B25B 23/10 | 81/453 |
| 6,314,845 | B1 * | 11/2001 | Wu | B23P 19/006 | 81/454 |
| 7,069,826 | B2 * | 7/2006 | Tilton | B25B 23/101 | 81/452 |

* cited by examiner

SCREW CLAMPING DEVICE

CROSS-REFERENCE TO RELATED APPLICATION

This non-provisional application claims priority under 35 U.S.C. § 119(a) on Patent Application No(s). 106134568 filed in Taiwan, R.O.C. on Oct. 6, 2017, the entire contents of which are hereby incorporated by reference.

FIELD OF THE INVENTION

The present invention relates to a clamping device and, more particularly, to a screw clamping device for clamping screws.

BACKGROUND OF THE INVENTION

In general, machines, electronic apparatuses, and fittings are usually assembled and fixed in place by screws. However, screws being tightened or loosened with a screwdriver are likely to fall off the screwdriver for lack of physical connection between the screwdriver and each screw. Furthermore, it is difficult to tighten or loosen screws in limited operating space. Moreover, any screw detached and buried in a machine may damage the machine and thus cause enormous financial losses. Last but not least, physical connection between a screw and a magnetic screwdriver is improved, albeit insufficient, let alone unfit for use with screws made of non-magnetic materials, such as copper, aluminum and stainless steel. In attempt to improve the aforesaid prior art, screw clamping devices are developed to prevent screws from falling off while being tightened or loosened.

In attempt to prevent screws from falling off while being tightened or loosened, some conventional screw clamping devices feature a screwdriver with a tip made of a resilient material. The resilient screwdriver tip is of a special shape and is deformed as soon as the screwdriver is pressed downward under a force. The resilient screwdriver tip thus deformed clamps or releases a screw. However, the resilient screwdriver tip in operation is deformed too little to enable the screwdriver tip to come into contact with a screw. Furthermore, the deformed resilient screwdriver tip is of too low mechanical strength to clamp a screw tightly, thereby causing the screw to loosen. The other conventional screw clamping devices feature a movable mechanism for controlling a chuck to open and shut but have disadvantages as follows: inconvenient to use (because manual operation is required) and structurally complicated.

SUMMARY OF THE INVENTION

In view of the aforesaid drawbacks of the prior art, it is an objective of the present invention to provide a screw clamping device whereby screws are clamped to prevent the screws from falling off or even getting missing while being loosened or tightened.

Another objective of the present invention is to provide a screw clamping device coupled to a screwdriver by modularization to further broaden the application of the screw clamping device.

In order to achieve the above and other objectives, the present invention provides a screw clamping device which comprises a body, a pressing unit, a resilient unit, a clamping unit and a connecting unit. The body is a hollow-core cylinder, is subject to axial penetration of a screwdriver, and is movable axially in synchrony with rotation of the screwdriver. The pressing unit is pressed against the body and adapted to press against a surface of a working object. The resilient unit is disposed between the body and the pressing unit. The clamping unit is rotatably connected to the body. The connecting unit has one end connected to the pressing unit and the other end connected to the clamping unit. The connecting unit drives the clamping unit to rotate while the body is moving axially.

While a user is operating the screwdriver, the body is driven to move, whereas the connecting unit drives the clamping unit to rotate and thereby clamp or loosen the screws.

In an embodiment, the clamping unit comprises at least a clamping arm with an end in the form of a C-shaped object.

In an embodiment, an end of the pressing unit comprises an L-shaped object.

In an embodiment, an end of the body has a plurality of dents for receiving the pressing unit and the clamping unit.

In an embodiment, the body has an inner wall, and the screwdriver is in tight contact with the inner wall for fixing the body.

In an embodiment, the clamping arms are in the number of two and symmetrically arranged on the clamping unit, with the two C-shaped objects formed at the two clamping arms, respectively, obliquely in opposite directions.

According to another objective of the present invention, the present invention provides a screw clamping device which comprises a body, a fixing unit, a pressing unit, a resilient unit, a clamping unit and a connecting unit. The body is a hollow-core cylinder which is subject to axial penetration of a screwdriver. The fixing unit is connected to the body axially and fixed with the screwdriver, and the fixing unit is driven to press against the body to move axially when the screwdriver is rotating. The pressing unit presses against the body and is adapted to press against a surface of a working object. The resilient unit is disposed between the body and the pressing unit. The clamping unit is rotatably connected to the body. The connecting unit has one end connected to the pressing unit and another one end connected to the clamping unit. The connecting unit drives the clamping unit to rotate while the body is moving axially.

Thus, the screw clamping device uses the fixing unit to push the body to move axially. When the screwdriver is rotating, the screwdriver only driving the fixing unit to rotate, and the body, the pressing unit, the clamping unit and the connecting unit only move up and down. Therefore, the screw clamping device is more stable in the operation.

In an embodiment, the clamping unit comprises at least a clamping arm with an end in the form of a C-shaped object.

In an embodiment, an end of the pressing unit is an L-shaped object.

In an embodiment, an end of the body has a plurality of dents for receiving the pressing unit and the clamping unit.

In an embodiment, the fixing unit comprises a plurality of screws penetratingly disposed at the fixing unit to press against the screwdriver.

In an embodiment, the clamping arms are in the number of two and symmetrically arranged on the clamping unit, with the two C-shaped objects formed at the two clamping arms, respectively, wherein the two C-shaped objects are oblique in opposite directions.

DETAILED DESCRIPTION OF THE PREFERRED EMBODIMENTS

Implementation of the present invention is hereunder illustrated by specific embodiments. Persons skilled in the art can easily understand other advantages and effects of the present invention by referring to the disclosure contained in the specification.

Figure 1:
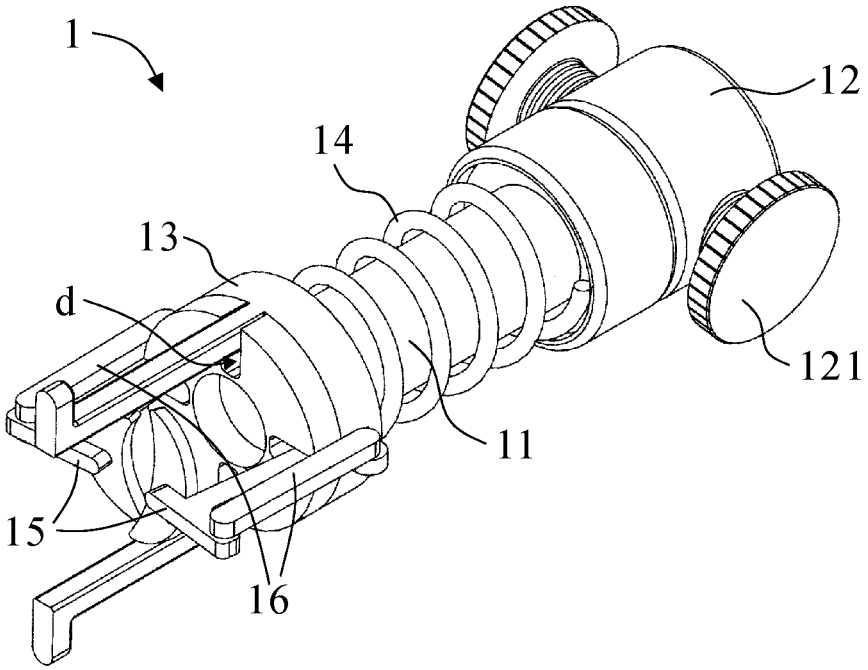
FIG. 1 is a schematic view of a screw clamping device according to an embodiment of the present invention.
Figure 2:
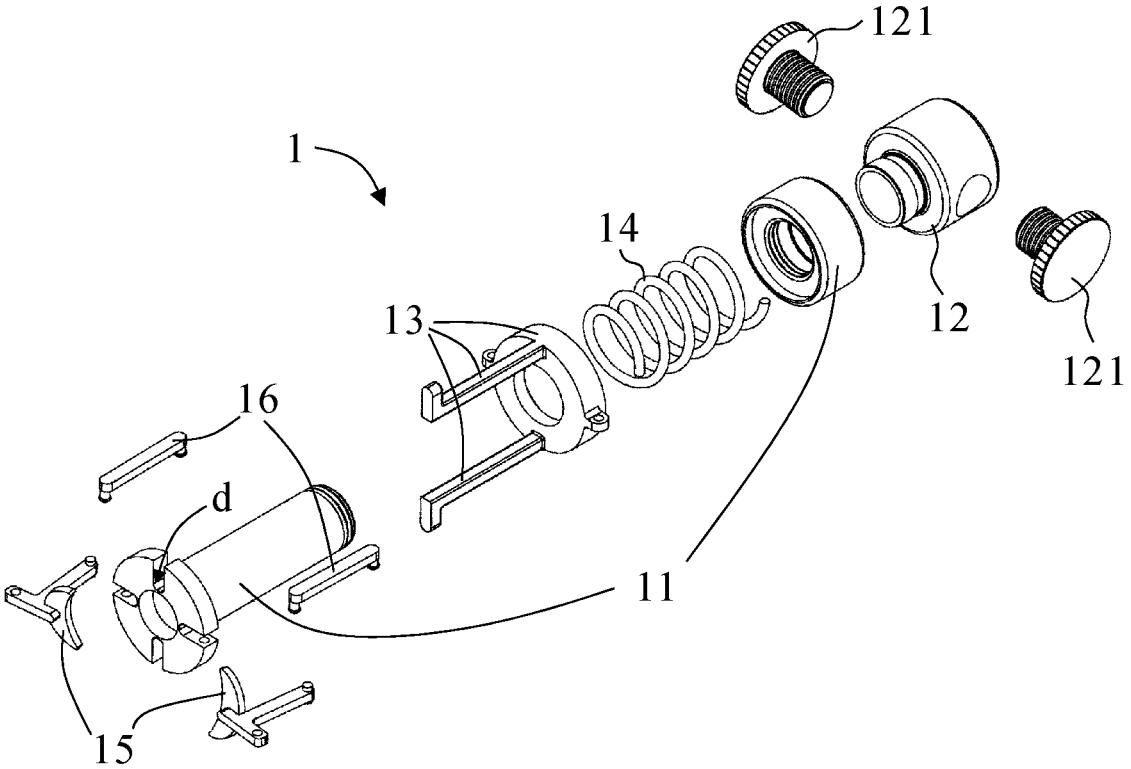
FIG. 2 is an explode view of the screw clamping device of FIG. 1.
Figure 3:
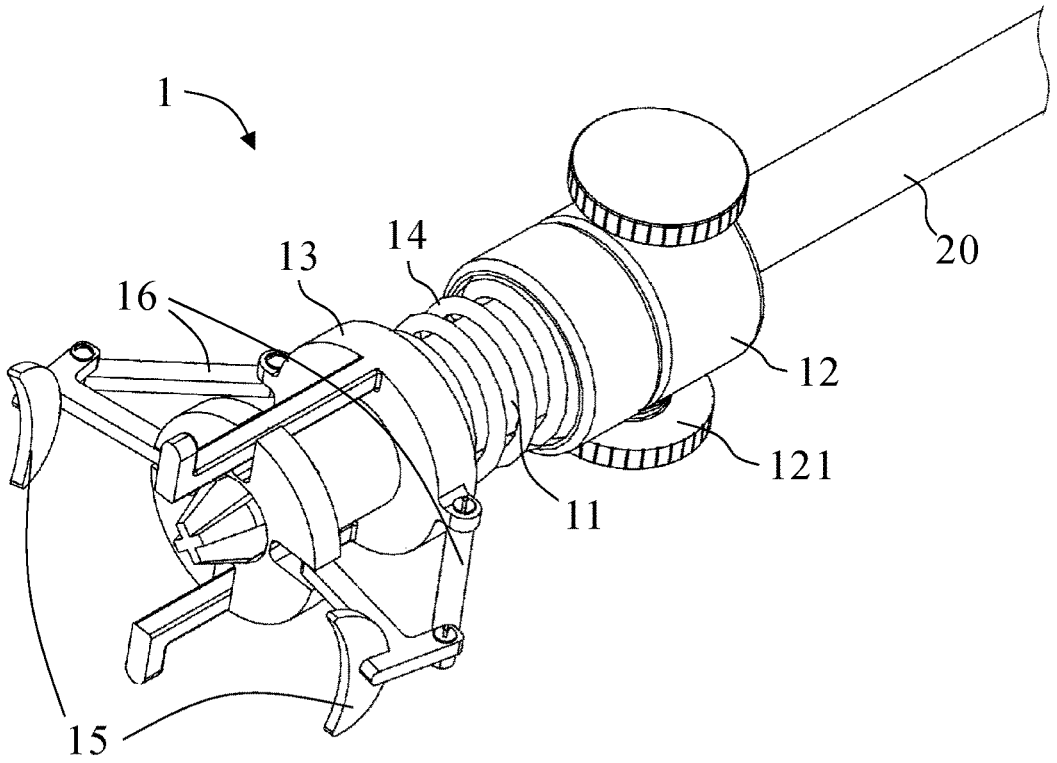
FIG. 3 is a schematic view in another perspective of the screw clamping device of FIG. 1.
Figure 4:
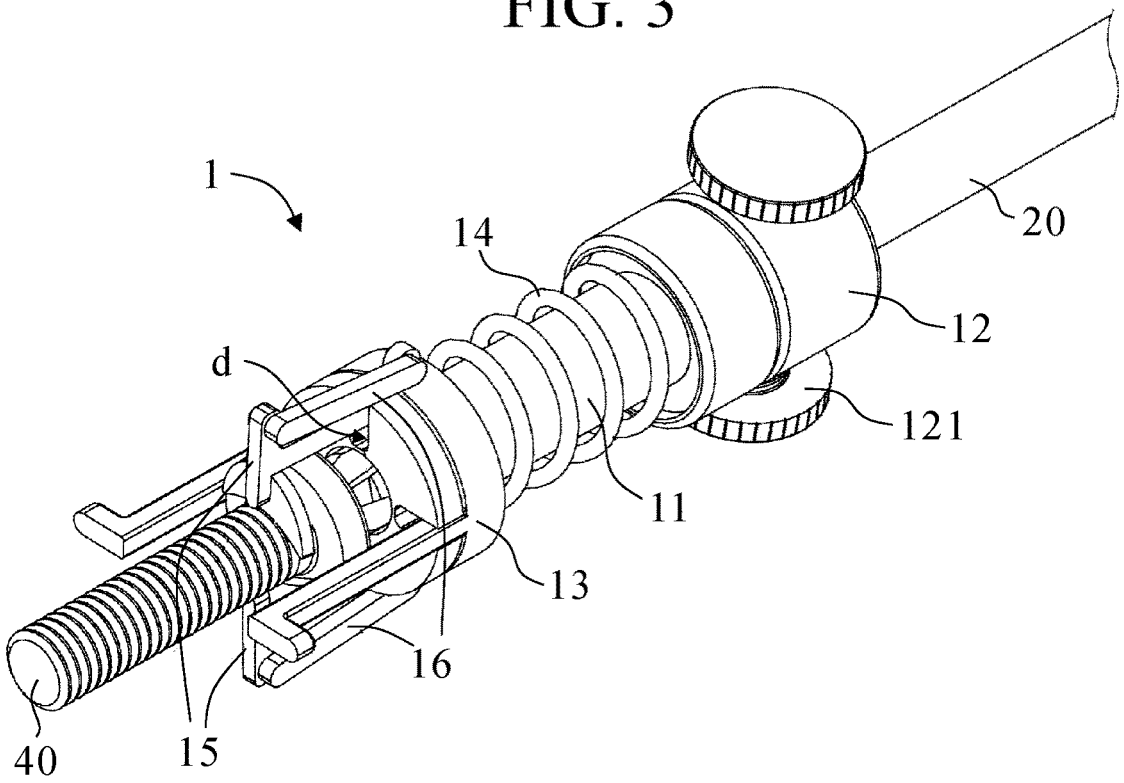
FIG. 4 is a clamping schematic view of the screw clamping device of FIG. 1.
Figure 5:
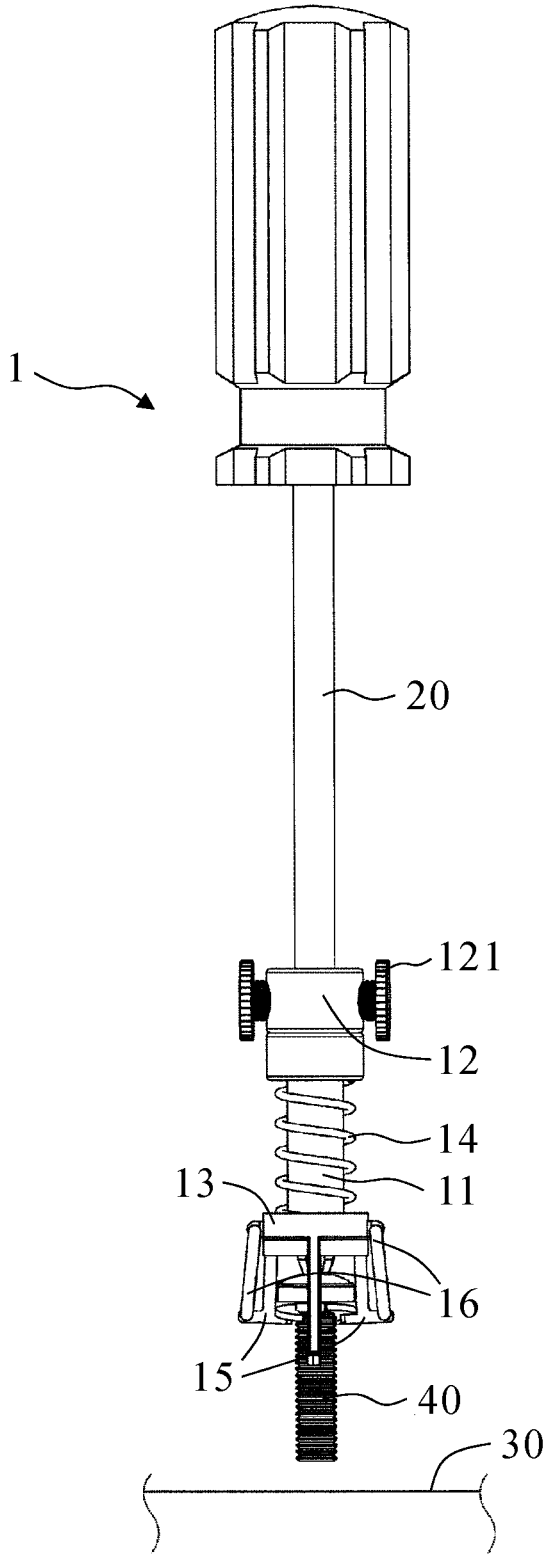
FIG. 5 is a schematic view of operation of the screw clamping device of FIG. 1.
Figure 6:
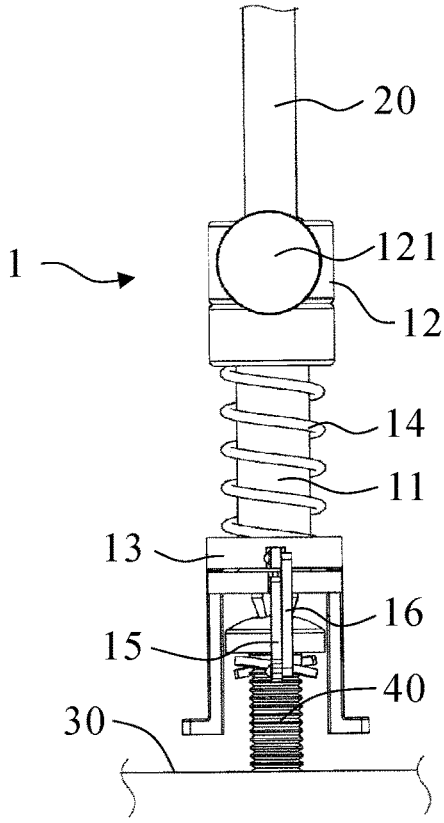
FIG. 6 is a schematic view of operation of the screw clamping device of FIG. 1.

Referring to FIG. 1 and FIG. 2, there are a schematic view and an explode view respectively of a screw clamping device 1 according to an embodiment of the present invention. As shown in the diagrams, the screw clamping device 1 comprises a body 11, a fixing unit 12, a pressing unit 13, a resilient unit 14, at least two clamping unit 15 and at least two connecting unit 16. The body 11 includes a head part 111 and a hollow-core cylinder 112. The head part 111 is disposed at a first end of the cylinder 112. The cylinder 112 has an axial direction for a screwdriver to be fixed along the axial direction. The head part 111 has a diameter larger than a diameter of the cylinder 112. The head part 111 has four dents d. The fixing unit 12 is disposed on the second end of the cylinder 112 and rotates relative to the body freely. The fixing unit 12 comprises a plurality of screws 121 that penetrating the fixing unit 12. Referring to FIG. 5, the pressing unit 13 includes a sleeve portion 131 and a pressing portion 132. The sleeve portion 132 is sleeved on the cylinder 112. The pressing portion 132 is an L-shaped object. The pressing portion 132 is connected to the sleeve portion 131 and is received in the dents d of the body 11 for pressing against the surface of a working object 30. The resilient unit 14 is disposed on the cylinder 112, and one end of the resilient unit 14 pressing sleeve portion 131. Referring to FIG. 4, the clamping unit 15 is disposed in the dents d and is received in the dents d of the body 11. The two clamping units 15 are symmetrically arranged thereon. The clamping unit 15 comprises a clamping arm 151 and a C-shaped object 152. The clamping arm 151 is disposed in the dent d. Referring to FIG. 6, the C-shaped objects 152 are disposed at one end of the clamping arms 151, respectively, obliquely in opposite directions. Therefore, to grip a screw 40, the C-shaped objects of the clamping unit 15 slide into the head of the screw 40 obliquely. With the C-shaped objects 152 being formed at the two clamping arms obliquely in opposite directions, not only is it impossible for the screw 40 to tilt in the course of the aforesaid process, but the C-shaped objects 152 are also applicable to screws 40 of different sizes. The connecting unit 16 is with a long strip shape, and one end of the connecting unit 16 is connected to the sleeve portion 131. And the other end is connected to the clamping arms 151.

Figure 7:
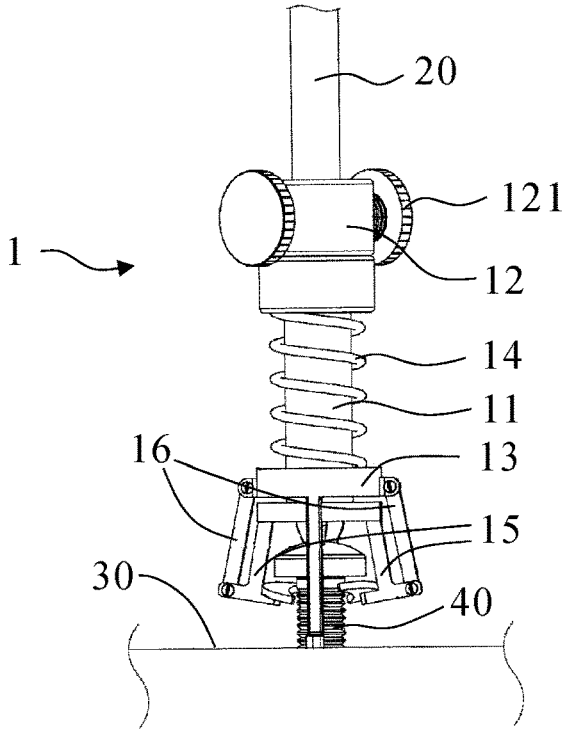
FIG. 7 is an unclamping schematic view of the screw clamping device of FIG. 1.
Figure 8:
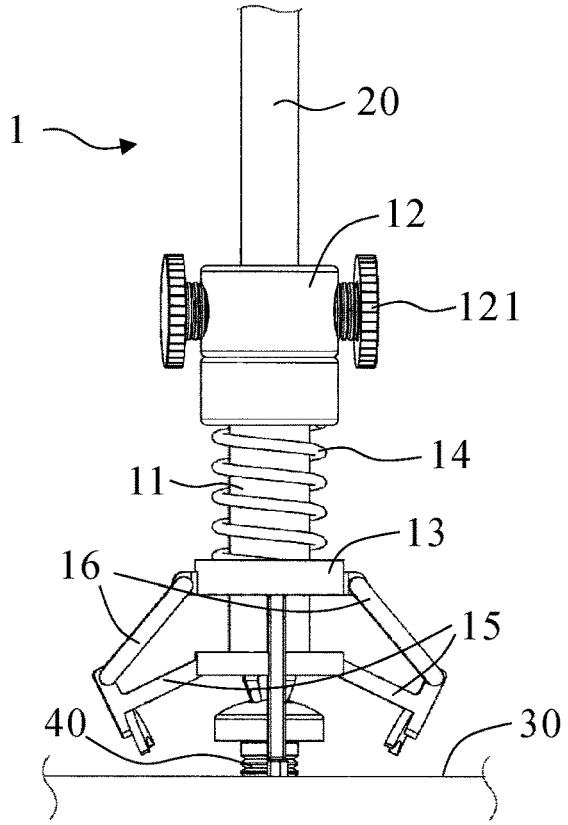
FIG. 8 is an expanded schematic view of a clamping unit of the screw clamping device of FIG. 1.
Figure 9:
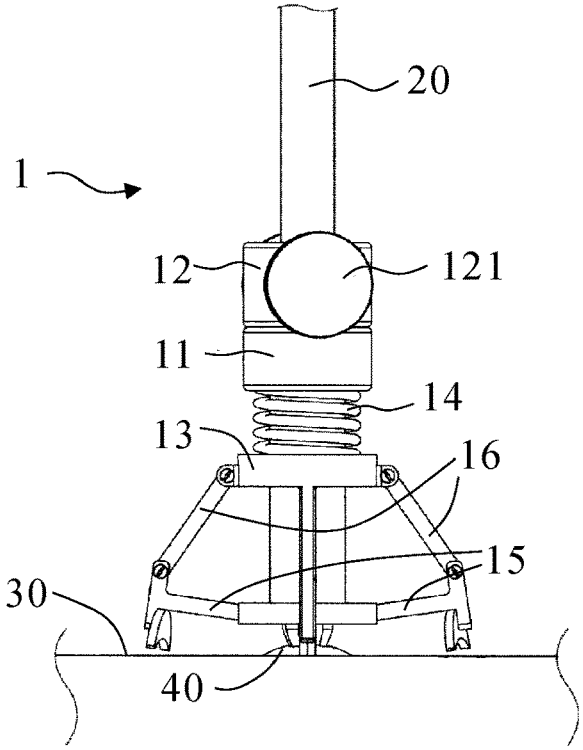
FIG. 9 is an expanded schematic view of the clamping unit of the screw clamping device of FIG. 1.
Figure 10:
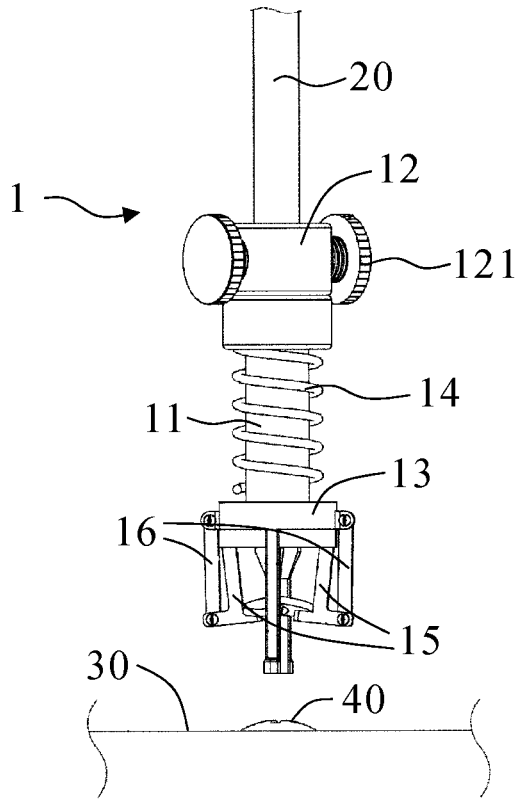
FIG. 10 is a restored schematic view of the screw clamping device of FIG. 1.

Referring to FIG. 3 through FIG. 9, there are shown schematic views of operation of the screw clamping device 1 according to the aforesaid embodiment of the present invention. As shown in FIG. 3 through FIG. 9, the screw clamping device 1 fits around a screwdriver 20, the screwdriver 20 penetrates the body 11 and fixing unit 12 axially and is coupled to the fixing unit 12 through screws 121. Afterward, as shown in FIG. 5, the intended screw 40 is placed at one end of the screwdriver 20, and then both the screwdriver 20 and the screw 40 are moved to the working object 30. As shown in FIG. 6, with the screw 40 being clamped by the clamping unit 15 of the screw clamping device 1, the screw 40 is clamped and fixed to one end of the screwdriver 20, allowing the screw 40 to be driven into the working object 30 while being rotated by a user. As shown in FIG. 7, when the pressing portion 132 of the screw clamping device 1 coming into contact with the working object, the fixing unit 12 is move down according to the rotation of the screwdriver 20 and pressing the second end of the cylinder 112, and head part 111 is moving down. Since the pressing portion 132 presses the working object 30 and the sleeve portion 131 is fixed, the head portion 111 is separated from the sleeve portion 131. Therefore, the connecting unit 16 is stretched to make the two C-shaped objects 152 of the two clamping units 15 relatively separated. The two C-shaped objects 152 are no longer clamping the screw 40. As shown in FIG. 8, in the situation where the user keeps driving the screw 40 into the working object 30 by rotating the screw 40, the rotation of the screwdriver 20 causes the screw 40 to be driven into the working object 30 but does not cause the body 11 to rotate, because the body 11 and the fixing unit 12 are movable. The body 11 compresses the resilient unit 14 and move downward along the screwdriver 20; as a result, the connecting unit 16 drives the clamping unit 15 to rotate and stretch outward, thereby releasing the screw 40. As shown in FIG. 9, the clamping unit 15 is no longer clamping the screw 40 after the screw 40 has been driven into the working object 30. As shown in FIG. 10, by contrast, the pressing unit 13 becomes a fixing end of the resilient unit 14 as soon as the screw 40 is screwed in or out of the working object 30, and in consequence the body 11 moves upward while restoration of the initial state of the resilient unit 14 is taking place; hence, again, the connecting unit 16 drives the clamping unit 15 to rotate and thereby restore or clamp the screw 40. Therefore, the screw clamping device 1 of the present invention prevents the screw 40 from falling off or even getting missing while being loosened or tightened. Furthermore, the screw clamping device 1 of the present invention can be coupled to the screwdrivers 20 of different sizes to further broaden the application of the screw clamping device 1.

Figure 11:
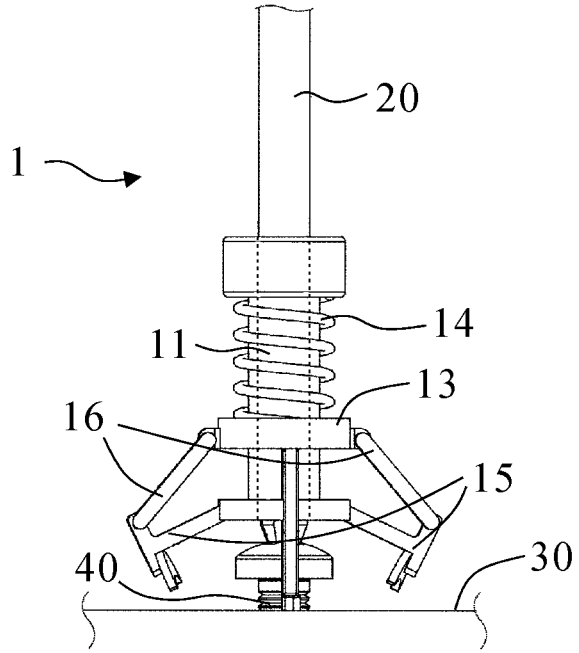
FIG. 11 is a schematic view of the screw clamping device according to another embodiment of the present invention.

Referring to FIG. 11, in another embodiment, the present invention dispenses with the fixing unit 12 as described below. The inner wall of the body 11 is made of an elastic material, such as rubber. After penetrating the body 11, the screwdriver 20 stretches the body 11 and thus is in tight contact with the inner wall of the body 11. Owing to the friction between the inner wall and the screwdriver 20, the screwdriver 20 and the body 11 are fixed to each other.

Given the aforesaid technical features of the screw clamping device 1 of the present invention, the body 11, the resilient unit 14, the pressing unit 13, the connecting unit 16 and the clamping unit 15 each rotate together with the screwdriver 20. The screw clamping device 1 rotates about the screw 40 without collisions, because the screw 40 is located at the center of each of the two clamping units 15.

As mentioned before, the present invention dispenses with the fixing unit 12, thereby further simplifying the structure of the screw clamping device 1.

The above embodiments are illustrative of the features and effects of the present invention rather than restrictive of the scope of the substantial technical disclosure of the present invention. Persons skilled in the art may modify and alter the above embodiments without departing from the spirit and scope of the present invention. Therefore, the scope of the protection of rights of the present invention should be defined by the appended claims.

What is claimed is:

1. A screw clamping device, comprising:

a body including a head part and a hollow-core cylinder, wherein the head part is disposed at a first end of the cylinder, the head part has a diameter larger than a diameter of the cylinder, the head part comprises a plurality of dents, and the cylinder has an axial direction for a screwdriver to be fixed along the axial direction;

a pressing unit comprising a sleeve portion and a pressing portion, wherein the sleeve portion is sleeved on the cylinder, the pressing portion is connected to the sleeve portion and is received in at least one of said plurality of dents to press against a surface of a working object;

a resilient unit disposed on the cylinder, one end of the resilient unit pressing against the sleeve portion and the other end of the resilient unit pressing against the head part, wherein the head part is separated from the sleeve portion;

at least two clamping units, each comprising a clamping arm and a C-shaped clamping portion, wherein each of the clamping arms is pivotally connected to a respective dent of said plurality of dents different from the dent receiving the pressing portion, each of the C-shaped clamping portions is connected to an end of a respective clamping arm of said clamping arms; and at least two connecting units, wherein each connecting unit comprises an elongated connecting arm, one end of each of the elongated connecting arms is connected to the sleeve portion, and the other end of each of the elongated connecting arms is connected to a respective one of the clamping arms.

2. The screw clamping device of claim 1, wherein an end of the pressing portion comprises an L-shaped arm, the surface of the working object is pressed against the bottom of the L-shaped arm.

3. The screw clamping device of claim 1, wherein the body comprises an inner wall, such that the screwdriver is in contact with the inner wall for fixing the body.

4. The screw clamping device of claim 1, wherein the clamping arms are symmetrically arranged, wherein the C-shaped clamping portions an obliquely in opposite directions.

5. A screw clamping device, comprising:

a body including a head part and a hollow-core cylinder, wherein the head part is disposed at a first end of the cylinder, the head part has a diameter larger than a diameter of the cylinder, the head part comprises a plurality of dents, and the cylinder has an axial direction for a screwdriver to pass along the axial direction;

a fixing unit disposed on the second end of the cylinder and fixed with the screwdriver, the fixing unit being driven for pressing against the body moved along the axial direction when the screwdriver is rotating;

a pressing unit comprising a sleeve portion and a pressing portion, wherein the sleeve portion is sleeved on the cylinder, the pressing portion is connected to the sleeve portion and is received in at least one of said plurality of dents to press against a surface of a working object;

a resilient unit disposed on the cylinder, one end of the resilient unit pressing against the sleeve portion and the other end of the resilient unit pressing against the head part, wherein the head part is separated from the sleeve portion;

at least two clamping units, each comprising a clamping arm and a C-shaped clamping portion, wherein each of the clamping arms is pivotally connected to a respective dent of said plurality of dents different from the dent receiving the pressing portion, each of the C-shaped clamping portions is connected to an end of a respective clamping arm of said clamping arms; and at least two connecting units, wherein each connecting unit comprises an elongated connecting arm, one end of each of the elongated connecting arms is connected to the sleeve portion, and the other end of each of the elongated connecting arms is connected to a respective one of the clamping arms.

6. The screw clamping device of claim 5, wherein an end of the pressing portion comprises an L-shaped arm, the surface of the working object is pressed against the bottom of the L-shaped arm.

7. The screw clamping device of claim 5, wherein the fixing unit comprises a plurality of screws penetratingly disposed perpendicular to the axial direction to press against the screwdriver.

8. The screw clamping device of claim 5, wherein the clamping arms are symmetrically arranged, with two said C-shaped objects formed at two said clamping arms, respectively, wherein the C-shaped clamping portions are obliquely in opposite directions.

* * * * *